United States Patent [19]

Kitamura et al.

[11] 4,377,150

[45] Mar. 22, 1983

[54] APPARATUS FOR ASSISTING ENGINE STARTING

[75] Inventors: Hidetoshi Kitamura; Takeo Oyama, both of Tokyo, Japan

[73] Assignee: Nissan Motor Co., Ltd., Yokohama, Japan

[21] Appl. No.: 141,697

[22] Filed: Apr. 18, 1980

[30] Foreign Application Priority Data

Apr. 23, 1979 [JP] Japan ..... 54-53362[U]

[51] Int. Cl.[3] ..... F02M 23/00

[52] U.S. Cl. ..... 123/588; 123/179 R; 123/198 DB

[58] Field of Search ..... 123/585, 588, 327, 198 DB, 123/179 R, 179 G, 179 L

[56] References Cited

U.S. PATENT DOCUMENTS

| | | | |
|---|---|---|---|
| 2,230,184 | 1/1941 | Horton | 123/179 G |
| 3,486,594 | 12/1969 | Wren, Jr. | 123/327 |
| 3,744,471 | 7/1973 | Braun et al. | 123/198 DB |
| 3,818,701 | 6/1974 | Foster et al. | 123/198 DB |
| 3,820,326 | 6/1974 | Inoue et al. | 123/588 |
| 3,885,545 | 5/1975 | Charron et al. | 123/179 G |
| 3,977,380 | 8/1976 | Atsumi et al. | 123/179 G |
| 4,043,310 | 8/1977 | Ichimiya et al. | 123/179 G |
| 4,072,137 | 2/1978 | Hattori et al. | 123/588 |
| 4,098,241 | 7/1978 | Tateno et al. | 123/588 |
| 4,195,602 | 4/1980 | Tamashita et al. | 123/588 |
| 4,224,913 | 9/1980 | Barnard | 123/179 G |

*Primary Examiner*—Charles J. Myhre
*Assistant Examiner*—E. Rollins Cross
*Attorney, Agent, or Firm*—Lane, Aitken & Kananen

[57] ABSTRACT

An internal combustion engine provided with an idling adjusting device including a by-pass air passage which by-passes a throttle valve in a main air passage. The engine is further provided with an auxiliary air introducing device which increases the cross-sectional area of the by-pass air passage as engine temperature and/or ambient air temperature are above respectively predetermined temperatures during starting operation of the engine.

4 Claims, 5 Drawing Figures

APPARATUS FOR ASSISTING ENGINE STARTING

BACKGROUND OF THE INVENTION

The present invention relates to an apparatus for the assisting starting operation of an internal combustion engine provided with a carburetor or fuel injection device.

As is well known, the viscosity and specific weight of fuel supplied to an internal combustion engine decrease and the evaporation of the fuel is promoted as the fuel temperature increases. Thus, in an engine whose carburetor or fuel injection device has been adjusted in the unheated condition of the engine, the suction air-fuel mixture of the engine tends to be enriched as the engine temperature and hence the fuel temperature increases. Further, as the air temperature in the engine room or ambient air temperature becomes excessively high, the charging efficiency of the engine is decreased by the decreased specific weight of the fuel, by which also the mixture is enriched.

In order to improve the starting characteristic of the engine, the mixture is conventionally enriched during the starting operation when a suction air throttle valve is fully closed. Thus, at the time of the so-called hot restarting of the engine shortly after the engine has been stopped, the mixture is excessively enriched resulting in an incomplete combustion, and the starting operation cannot be effected easily.

Accordingly, it has been a conventional practice to open the throttle valve by depressing an accelerator pedal so as to avoid the excessively enriched condition at the time of a hot restarting operation. But, the enriched condition cannot always be avoided since such an operation is difficult to control properly and requires the driver's dexterity. Further, it is known to provide the air cleaner of a carburetor-equipped engine with an idling compensating device by which, however, effective and sufficient compensation cannot be achieved.

BRIEF SUMMARY OF THE INVENTION

Accordingly, it is an object of the present invention to provide an apparatus for assisting the starting operation of an internal combustion engine, by which the hot restarting can be effected easily and positively even by an unskilled driver.

The apparatus according to the present invention comprises a main air passage, a throttle valve inserted into the main air passage, a by-pass air passage by-passing the throttle valve, an engine starting switch, means to detect at least one of the engine temperature and ambient air temperature, and an auxiliary air introducing means inserted into the by-pass air passage and controlled by the engine starting switch and the temperature detecting means, the auxiliary air introducing means being arranged such that the cross-sectional area of the by-pass air passage is increased during the engine starting operation under a condition in which the engine temperature and/or ambient air temperature are above respectively predetermined temperatures.

BRIEF DESCRIPTION OF THE DRAWINGS

The present invention will now be described in detail by referring to a preferred embodiment shown in the drawings, in which.

DETAILED DESCRIPTION OF THE PREFERRED EMBODIMENT

Figure 1:
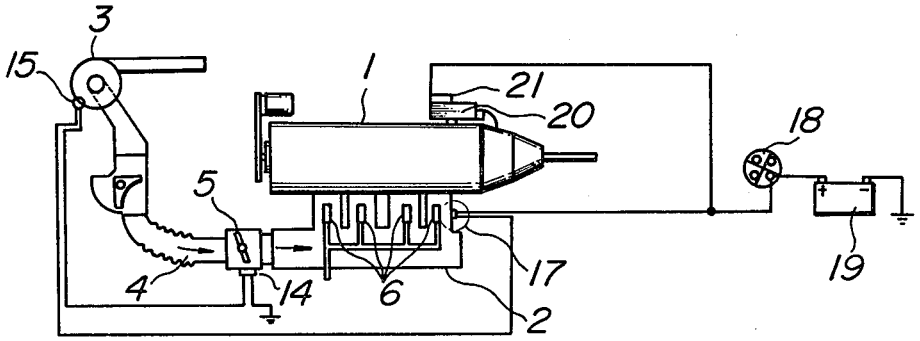
FIG. 1 is a schematic illustration of an internal combustion engine provided with an apparatus according to one embodiment of the present invention.
Figure 2:
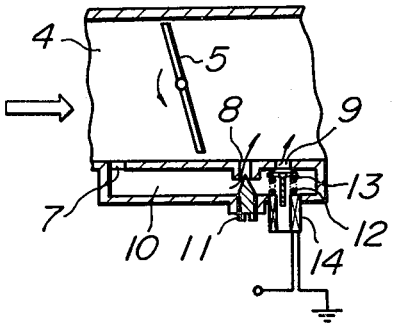
FIG. 2 is a fragmentary sectional view of a portion of the apparatus in FIG. 1.

Referring now to FIG. 1, an internal combustion engine 1 to which the present invention may be applied includes a suction manifold 2 which is opened into atmosphere through an air cleaner 3 and a suction conduit 4 having therein a suction air throttle valve 5 for regulating the quantity of suction air to be supplied to the engine. The suction manifold 2 is provided with a fuel injection device 6 connected to a fuel injection controlling device (not shown) which controls the quantity of fuel to be injected in accordance with the driving condition after starting the engine. As shown in FIG. 2, the suction conduit 4 is provided with an inlet port 7 upstream of the throttle valve 5, and with an idling port 8 and a starting port 9 downstream of the throttle valve 5. Those ports 7, 8 and 9 are communicated with each other through a by-pass suction passage 10.

Figure 3:
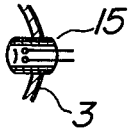
FIG. 3 is a sectional view showing the manner of mounting the ambient air temperature sensor.
Figure 4:
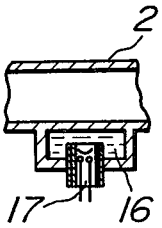
FIG. 4 is a sectional view showing the manner of mounting the cooling water temperature sensor.

As in a conventional arrangement, the idling port 8 is provided with an idle adjusting screw 11. The starting port 9 is provided with an auxiliary air introducing device in the form of a starting valve 13 normally closed by a spring 12 so that the upstream and downstream sides of the throttle valve 5 are by-pass connected only through the inlet port 7 and the idling port 8 whose opening degree is adjusted by the screw 11. A solenoid 14 which opens the starting valve 13 against the spring 12 is connected, through an ambient air temperature sensor 15 (FIG. 3) associated with the air cleaner 3, and a cooling water temperature sensor 17 (FIG. 4) disposed in a cooling water passage 16, with a starting terminal of an ignition key switch 18 which, in turn, is connected with a vehicle-mounted battery 19. The starting terminal of the ignition key switch 18 is further connected with a relay switch 21 of a starter 20 which starts the engine 1. The ambient air temperature sensor 15 and the cooling water temperature sensor 17 are connected in series with each other. Each of the sensors is maintained nonconductive when the temperature detected thereby is below a predetermined temperature, e.g. 50° C. for the ambient air or 80° C. for the cooling water, and becomes conductive when the detected temperature reaches or exceeds the predetermined temperature.

With the above arrangement, under the condition in which each of the engine cooling water temperature and the ambient air temperature is below the respectively predetermined temperature, both of the sensors 15 and 17 are maintained non-conductive. Thus, even when the ignition key switch 18 is switched into the starting position, the solenoid 14 is not energized. Consequently, the starting valve 13 is left closed by the force of the spring 12 so that the opening of the by-pass air passage 10 by-passing the throttle valve 5 is formed by the idling port 8 only, which is adjusted by the screw 11. In other words, in this operating condition, the by-pass air quantity of the valve 5 is controlled as in the conventional arrangement.

Under the operating condition in which each of the engine cooling water temperature and the ambient air temperature is more than the predetermined temperature, e.g. just after the engine has been stopped, both of the sensors 15 and 17 become conductive. Thus, by operating the ignition key switch 18 into the starting position to drive the engine starter 20, the solenoid 14 is energized at the same time. Consequently, the starting valve 13 is moved against the spring 12 to open the starting port 9 so that the by-pass air from the inlet port 7 and flowing through the passage 10 flows into the suction conduit 2 at the downstream side of the throttle valve 5 through the idling port 8, and through the starting port 9 also. The by-pass air from the starting port 9 increases the quantity of suction air with respect to the quantity of supplied fuel which depends upon the opening degree of the throttle valve 5, to thereby avoid undesirable enrichment of the air-fuel mixture due to increase in the fuel temperature. Since a sufficient quantity of air is supplied to the engine, in the opened condition of the starting port 9, compensation can be made with regard to the increased quantity of the supplied fuel and the augmented evaporation ratio of the fuel due to the increased fuel temperature, as well as a decrease in the suction air charging efficiency due to the increased ambient air temperature, so as to avoid an excessive enrichment of the air-fuel mixture and to facilitate the hot restarting operation of the engine.

Under the operating condition in which one of the ambient air temperature and the engine cooling water temperature is below the predetermined temperature, one of the sensors 15 and 17 remains non-conductive so that the solenoid 14 is not energized. Since the starting valve 13 is not opened and the suction air quantity is not increased, the air-fuel mixture is prevented from achieving an excessively lean condition.

After starting the engine, although the ignition key switch 18 is switched from the starting position to the ignition position and the solenoid 14 is deenergized, the air-fuel mixture can easily be burnt. Moreover, the fuel injection control device is operated to avoid various disadvantages due to an excessively rich or lean air-fuel ratio.

Figure 5:
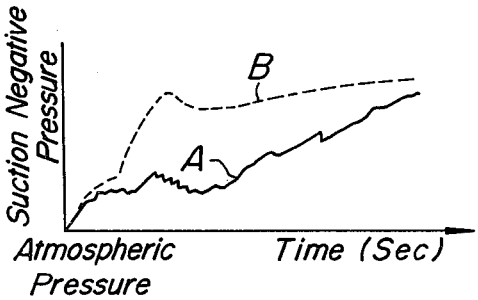
FIG. 5 is a graph showing the hot restarting characteristics of the conventional apparatus and the apparatus according to the present invention.

During the hot restarting operation, according to a conventional arrangement, as shown by the curve A in FIG. 5, it took considerable time until the suction negative pressure reaches a predetermined level after starting the starter, or the local combustion gradually propagates until a complete combustion is achieved. To the contrary, according to the present invention, since the mixture enrichment is avoided at the time of starting the starter, the complete combustion can be achieved in short a time, as shown by the curve B in FIG. 5.

The air-fuel mixture tends to be enriched due to the decreased suction air charging efficiency when the ambient air temperature only is above the predetermined temperature, or due to the increased engine temperature even when the ambient air temperature is low. Thus, the auxiliary air introducing device may be actuated when either one of the ambient air temperature and engine temperature is above the predetermined temperature. In this instance, the sensors 15 and 17 are connected to the solenoid 14 in parallel with each other. The engine temperature may be represented, other than the cooling water temperature, by the temperature of the engine body itself, fuel temperature or air temperature prevailing in the engine room.

The auxiliary air introducing device may increase the by-pass air quantity continuously in proportion to the detected temperature or output signal level of the temperature sensor, rather than stepwisely as in the illustrated embodiment. By this technique, the starting operation of an engine can be effected simply in all the operative temperature conditions. The temperature sensors may be of semiconductor type.

As is apparent from the foregoing, according to the present invention, the engine is provided with an auxiliary air introducing device which controls the by-pass air quantity at the time of restarting the engine in response to change in the ambient air temperature and/or engine temperature by which the characteristics of the fuel are greatly influenced. Accordingly, the engine can be started easily and positively at the time of cold starting, and particularly in the hot starting also, which required a specific operation of the accelerator pedal. Since the hot starting characteristic is greatly improved, emission of harmful exhaust gas constituents due to the excessively enriched air-fuel mixture inevitable in the hot starting by the conventional arrangement can be minimized.

What is claimed is:

1. An apparatus for assisting a hot-restarting operation of an internal combustion engine comprising a main air passage, a throttle valve inserted into the main air passage, a by-pass air passage by-passing the throttle valve, an engine starting switch, first means to detect the engine temperature, second means to detect ambient air temperature, and an auxiliary air introducing means inserted into the by-pass air passage and controlled by the engine starting switch and said temperature detecting means, the auxiliary air introducing means being a single valve having a control circuit therefor in which the first and second detecting means are connected in series with each other, and arranged such that air flow resistance through the by-pass air passage is reduced during the hot-starting operation of the engine under a condition in which the engine temperature and/or ambient air temperature are above respectively predetermined temperatures.

2. An apparatus as claimed in claim 1, wherein the by-pass air passage comprises an idling air passage of the engine.

3. An apparatus as claimed in claim 1, wherein the auxiliary air introducing means comprises an electromagnetic valve having a valve element, a spring normally biasing the valve element toward a closed position, and a solenoid coil connected to the engine starting switch and said temperature detecting means and adapted to displace the valve element against the spring toward an open position.

4. An apparatus as claimed in claim 1, wherein the first and second detecting means each consists of a temperature sensor generating an output signal proportional to the temperature detected thereby, said single valve being of a type in which the valve opening varies continuously in accordance with variation of the engine temperature and/or ambient air temperature.

* * * * *